US010144890B2

(12) United States Patent
Doering

(10) Patent No.: US 10,144,890 B2
(45) Date of Patent: Dec. 4, 2018

(54) METHOD AND APPARATUS FOR CONVERTING AN ALCOHOL INTO A MOTOR FUEL MIXTURE

(71) Applicant: MAN Truck & Bus AG, Munich (DE)

(72) Inventor: Andreas Doering, Munich (DE)

(73) Assignee: MAN TRUCK & BUS AG, München (DE)

( * ) Notice: Subject to any disclaimer, the term of this patent is extended or adjusted under 35 U.S.C. 154(b) by 0 days.

(21) Appl. No.: 15/419,247

(22) Filed: Jan. 30, 2017

(65) Prior Publication Data

US 2017/0145328 A1 May 25, 2017

Related U.S. Application Data

(62) Division of application No. 13/948,599, filed on Jul. 23, 2013.

(30) Foreign Application Priority Data

Jul. 26, 2012 (DE) ..... 10 2012 014 755

(51) Int. Cl.
*C10L 1/02* (2006.01)
*F02M 27/02* (2006.01)

(52) U.S. Cl.
CPC ..... *C10L 1/02* (2013.01); *C10L 1/026* (2013.01); *C10L 2270/026* (2013.01); *C10L 2290/562* (2013.01); *C10L 2290/567* (2013.01); *C10L 2290/58* (2013.01); *C10L 2290/60* (2013.01); *C10L 2300/30* (2013.01)

(58) Field of Classification Search
CPC ..... F02M 27/02; F02M 1/165; F02M 25/12; F02D 19/0655; F02D 19/0671; F02D 41/0025
See application file for complete search history.

(56) References Cited

U.S. PATENT DOCUMENTS 4,422,412 A 12/1983 Norton
4,455,394 A * 6/1984 Pinto ..... B01J 23/72 518/702
4,455,412 A 6/1984 Lydiate et al.
4,519,342 A 5/1985 Yoon
4,716,859 A 1/1988 Koenig
4,876,989 A * 10/1989 Karpuk ..... F02B 1/02 123/179.8
5,097,803 A 3/1992 Galvin
5,485,818 A * 1/1996 McCandless ..... F02B 3/06 123/27 R
5,504,259 A 4/1996 Diebold
(Continued)

FOREIGN PATENT DOCUMENTS

WO 2001/02515 A1 1/2001

*Primary Examiner* — Long T Tran
(74) *Attorney, Agent, or Firm* — Lucas & Mercanti, LLP

(57) ABSTRACT

A method and apparatus for converting an alcohol into a fuel mixture which consists of alcohol, ether and water and is suitable for operating a combustion engine, in particular an internal combustion engine in a motor vehicle, converts the alcohol into the fuel mixture in a reactor at a suitable reaction temperature. The mixing ratio of alcohol fraction, ether fraction and water fraction in the fuel mixture is adjusted by controlling at least one reaction parameter of a reaction taking place in the reactor.

14 Claims, 1 Drawing Sheet

(56) References Cited

U.S. PATENT DOCUMENTS 7,290,505 B2 11/2007 Kamio
7,370,609 B2 * 5/2008 Kamio ..... F02D 19/081 123/1 A
7,487,631 B2 2/2009 Cueman
7,487,762 B2 2/2009 Kaneko
7,523,739 B2 4/2009 Kaneko
7,630,822 B2 12/2009 Kaneko
7,661,414 B2 * 2/2010 Kamio ..... F02D 19/08 123/3
7,767,156 B2 8/2010 Ashe
7,770,545 B2 8/2010 Morgenstern
7,906,559 B2 * 3/2011 Olah ..... C01B 3/38 518/704
7,933,713 B2 4/2011 Leone
1,956,950 A1 6/2011 Lee Eun-Guk
8,015,951 B2 * 9/2011 Dearth ..... F02D 19/081 123/1 A
8,206,470 B1 * 6/2012 Jacobson ..... F02M 43/00 44/387
8,245,690 B2 8/2012 Stein
8,506,910 B2 * 8/2013 Singh ..... C01B 3/34 422/129
8,955,468 B2 2/2015 Duwig
9,109,498 B2 8/2015 Bradley
9,109,506 B2 8/2015 Gabrielsson
9,140,180 B2 9/2015 Gruber
9,228,543 B2 1/2016 De Landa Magarin
9,261,053 B2 2/2016 Jacob
9,511,663 B2 * 12/2016 McAlister ..... B60K 15/035
2002/0098394 A1 * 7/2002 Keefer ..... B01D 53/047 423/651
2003/0121481 A1 7/2003 Dodd
2006/0180099 A1 8/2006 Aimoto
2008/0127933 A1 6/2008 Blumberg
2010/0319635 A1 12/2010 Morgenstern
2011/0247573 A1 10/2011 McCann
2013/0000571 A1 * 1/2013 Duwig ..... C10L 1/02 123/3
2014/0275636 A1 * 9/2014 Zhang ..... C07C 41/09 568/698

* cited by examiner

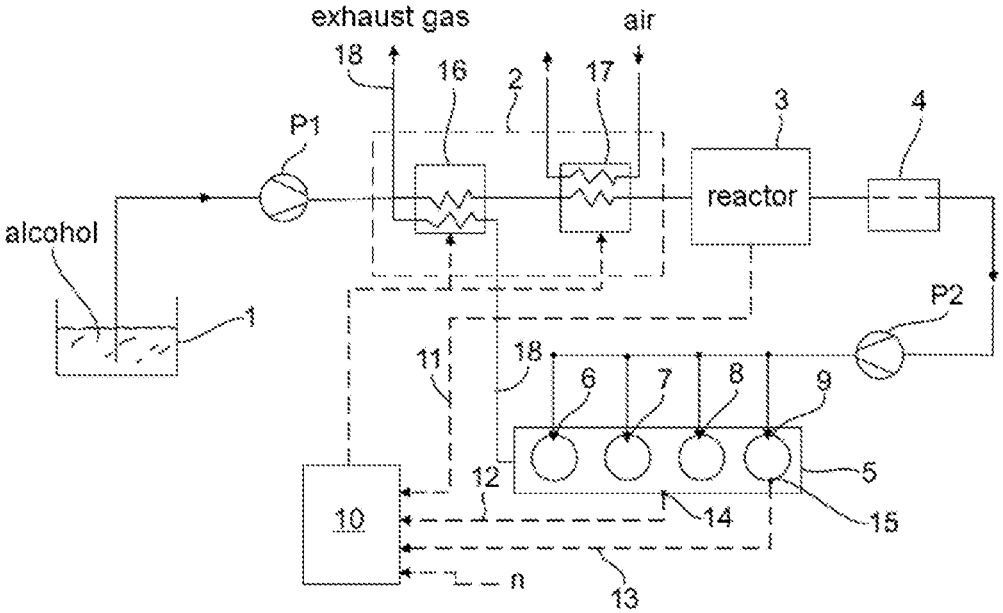
exhaust gas
air
18
16
2
17
3
4
P1
reactor
alcohol
1
P2
11
18
6
7
8
9
5
12
10
14
15
n
13

METHOD AND APPARATUS FOR CONVERTING AN ALCOHOL INTO A MOTOR FUEL MIXTURE

CROSS-REFERENCE TO RELATED APPLICATIONS

This application is a Divisional Application of U.S. application Ser. No. 13/948,599 filed Jul. 23, 2013, which claims the priority of DE 10 2012 014 755.4 filed Jul. 26, 2012, each of which is incorporated herein by reference in its entirety.

BACKGROUND OF THE INVENTION

The invention relates to a method for converting an alcohol into a motor fuel mixture and also to an apparatus for practicing the method.

Replacing conventional fossil motor fuels by alternative motor fuels is gaining more and more attention. Notably alcohols, such as methanol or ethanol, are attractive in this connection, since they are obtainable from regenerative sources in a relatively simple way. However, owing to their low cetane number, these motor fuels cannot be used in auto-ignition, diesel engines. To facilitate combustion in diesel engines, these motor fuels can be additized with additives, such as dimethyl ether or diethyl ether, for raising the cetane number.

A mixture of alcohol, ether and water can also be produced directly during the operation of a combustion engine, in an upstream process, from an alcohol, for example from methanol or ethanol, by using a suitable catalyst.

U.S. Pat. No. 4,422,412A discloses a method for converting an alcohol into a motor fuel mixture wherein the alcohol (methanol for example) which has been heated to a suitable reaction temperature is converted by means of a catalyst in a reactor into a motor fuel mixture in accordance with the accompanying reaction equation:

$$2\ CH_3OH \leftrightarrow CH_3—O—CH_3 + H_2O \qquad \text{reaction 1}$$

The methanol (CH3OH) used here is thus converted in the reactor to form additionally dimethyl ether ($CH_3$—O—CHs) and water ($H_2O$). When ethanol is used for the conversion method to produce the motor fuel mixture, a mixture of ethanol, diethyl ether and water can be produced using the reactor. Gamma-Aluminumoxide can be used as catalyst in the reactor.

The motor fuel mixture obtained according to this known method tends to vary greatly in quality, as evidenced by a greatly varying water content, and therefore in practice it cannot be used to run diesel engines. The variations in quality which occur lead to greatly varying cetane numbers and consequently to greatly varying igniting timing. Moreover, the motor fuel mixture obtained is not always equally suitable for all engine operating points.

SUMMARY OF THE INVENTION

The problem addressed by the invention is that of providing a method for converting an alcohol into a combustion engine fuel mixture of very consistent quality.

According to an embodiment of the present invention, the mixing ratio of alcohol fraction, ether fraction and water fraction in the motor fuel mixture is adjusted by controlling at least one reaction parameter. The mixing ratio of the motor fuel mixture resulting from the conversion of the alcohol depends inter alia on the reaction temperature, so the mixing ratio can be adjusted via an appropriate adjustment of the reaction temperature. The table below exemplifies the dependence of the mixing ratio on the reaction temperature at a reactor pressure of 2 MPa when methanol is used as the alcohol which is converted into a motor fuel mixture of alcohol, ether and water in a reactor:

| Reaction temperature [° C.] | Alcohol fraction [%] | Ether fraction [%] | Water fraction [%] |
|---|---|---|---|
| 200 | 8 | 67 | 25 |
| 300 | 14 | 62 | 24 |
| 400 | 19 | 59 | 22 |
| 500 | 22 | 57 | 21 |

Adjustment to a desired reaction temperature is possible by appropriately controlling the temperature of the supplied alcohol, for example methanol. Reaction pressure is a further reaction parameter which can be used to adjust the mixing ratio of the motor fuel mixture obtained according to the invention.

Investigations have shown that the formation of dimethyl ether (DME) as per reaction 1 proceeds in accordance with the following reaction rate model:

$$-\frac{dc_{DME}}{dt} = \frac{KrK_M^2 p_M^2}{(1 + K_M p_M)^2}$$

where $$-\frac{dc_{DME}}{dt}$$

is the amount of substance change rate of DME $K_M$ is the equilibrium constant of methanol $p_M$ is the methanol partial pressure $K_r$ is the rate constant of the reaction $$k_r = k_0 e^{-\frac{E_A}{RT}}$$

$$E_A \text{ is the activation energy } \left(\text{ca. } \frac{60\ \text{kJ}}{\text{mol}}\right)$$

It is clear from this that the rate of DME formation depends not only on the methanol partial pressure but also—via the temperature dependence of the rate constant $k_r$—on the reaction temperature.

By adjusting the mixing ratio of alcohol fraction, ether fraction and water fraction in the motor fuel mixture, comparatively simple open and closed loop control systems can deliver a desired cetane number. A cetane number of below 50 and/or an octane number of above 95 RON can be achieved to be able to operate a combustion engine in the operating region of homogeneous compression ignition, while a diesel engine fuel mixture having a cetane number of more than 50 can be produced through appropriate control of the reaction taking place in the reactor.

At least one reaction parameter can more particularly also be controlled according to operating parameters of the combustion engine for which the fuel mixture is intended. Hence the fuel mixture can be adapted in its properties, for example to operating parameters, such as charge pressure, speed and/or load, in order that optimized operation of the combustion engine may be achieved.

Reaction parameters can also be controlled according to operating parameters of an exhaust-gas aftertreatment system, for example in order to achieve a very clean burn in the combustion engine.

Reaction parameters can also be controlled according to the constitution of the alcohol used, in which case the purity of the alcohol used can also be taken into account as a reaction parameter.

Methanol or ethanol can be used for example to convert an alcohol into a motor fuel mixture, although to achieve desired motor fuel properties a methanol-ethanol mixture can also be used as the alcohol to be converted. The motor fuel mixture obtained using the method of the present invention may accordingly contain dimethyl ether and/or diethyl ether as ether fraction.

Another problem addressed by the invention is that of providing an apparatus for converting an alcohol into a combustion engine fuel mixture which can be varied with regard to its component fractions.

In an apparatus according to an embodiment of the invention, the alcohol supplied to the reactor is heated by means of a heating device. A control device adjusts the heating of the alcohol in the heating device according to reaction parameters of a conversion process taking place in the reactor and/or according to operating parameters of a related combustion machine. Appropriate heating of the supplied alcohol results in different reaction temperatures which can be varied between 200 and 500° C. for example. Depending on the setting for the reaction temperature, the reaction product obtained will be a motor fuel mixture having a desired alcohol/ether/water mixing ratio. The mixing ratio is determinative of the combustion properties of the fuel mixture in the combustion engine. These combustion properties can be adjusted in a simple manner by controlling the reaction temperature in a closed loop control system.

A preferred embodiment of the apparatus according to the invention comprises a heating device which consists of an exhaust-gas heat exchanger and an air heat exchanger. At least one of the two heat exchangers is controlled with regard to the heat transfer to the alcohol flowing therethrough and supplied to the reactor. The air heat exchanger therein preferably serves as a cooling device for cooling the alcohol heated in the upstream exhaust-gas heat exchanger down to a desired processing temperature. Only controlling the cooling by the air heat exchanger can suffice here to obtain a desired reaction temperature in the reactor.

Sensors measuring the temperature and/or pressure in the reactor can be used in a control device as part of a closed loop control system to control the heating of the supplied alcohol. A temperature closed loop control system of this type is realizable with comparatively simple means.

In addition, the pressure in the reactor can also be controlled/modulated independently of the temperature, for example by means of a pressure control valve and/or by varying the amount supplied and/or removed.

The reaction process taking place in the reactor can also be effected according to the cylinder pressure and/or knocking sensor signals. Cylinder pressure sensors and/or knocking sensors can be mounted on the combustion engine for this purpose, and transmit their measurement signals, via measurement lines, to the control device for adjusting the heating of the alcohol and/or the pressure in the reactor.

The control device for controlling the heating of the alcohol supplied to the reactor can also take account of further operating parameters of the combustion engine and its exhaust-gas aftertreatment system in order that fuel combustion may be optimized. More particularly, a reduced level of pollutants and also improved fuel economy can be achieved as a result.

BRIEF DESCRIPTION OF THE DRAWING

FIG. 1 shows a schematic depiction of an apparatus for converting an alcohol into a combustion engine fuel mixture according to an embodiment of the present invention.

DETAILED DESCRIPTION OF THE PREFERRED EMBODIMENT

The apparatus has a tank 1 which contains an alcohol (methanol or ethanol for example) which is fed by a first pump P1 through a heating device 2 to a reactor 3. In reactor 3, the alcohol is converted at a suitable reaction temperature into a motor fuel mixture which is fed via a chamber 4 and a second pump P2 to a combustion engine 5. The combustion engine 5 is for this equipped with injection nozzles 6 to 9, via which the motor fuel mixture is injected into the combustion chambers of combustion engine 5.

The apparatus depicted in FIG. 1 can more particularly be disposed in a motor vehicle with a diesel engine as combustion engine 5.

In order that the motor fuel mixture supplied to combustion engine 5 has a mixing ratio of its alcohol, ether and water fractions which is suitable for combustion engine 5, heating device 2 heats the alcohol before entry into reactor 3 to a suitable temperature therefor. The process of heating is controlled by a control device 10 according to two or more operating parameters. Measurement signals representing different operating parameters are sent for this via measurement signal lines 11 to 13 to the control device 10 from sensors provided in reactor 3 and on combustion engine 5. The reaction temperature and the reaction pressure are received by control device 10 from reactor 3 as measurement signals on which the mixing ratio of alcohol, ether and water in the motor fuel mixture depends. Moreover, a knocking sensor 14 and a cylinder pressure sensor 15 send corresponding measurement signals to the control device 10 which together with further operating state signals, for example speed n, load and acceleration, characterize the current operating state of combustion engine 5. On the basis of these operating parameters of combustion engine 5, control device 10 can determine a suitable mixing ratio for the motor fuel mixture and effect an appropriate adjustment to the reaction in reactor 3.

Heating device 2 in the depicted exemplary embodiment consists of an exhaust-gas heat exchanger 16 and an air heat exchanger 17. An exhaust-gas line 18 leads from combustion engine 5 through the exhaust-gas heat exchanger 16 and, inside the exhaust-gas heat exchanger 16, heats the alcohol likewise directed through the exhaust-gas heat exchanger 16. The heated alcohol passes from the exhaust-gas heat exchanger 16 to the air heat exchanger 17, where ambient air flowing therethrough can be used to cool the alcohol down to a desired temperature. Both the exhaust-gas heat exchanger 16 and the air heat exchanger 17 can be controlled heat exchangers, facilitating controlled heat transfer. For instance, a bypass control in exhaust-gas heat exchanger 16 can be used to ensure that only a certain proportion of the exhaust-gas stream is used to heat the alcohol flowing therethrough. In the case of air heat exchanger 17, controlled cooling of the alcohol flowing therethrough is possible by control device 10 controlling, for example, the air throughput through the air heat exchanger 17.

It will be appreciated that a different heat transfer medium, such as water or oil (not depicted here), can also be used for heat exchanger 17 in place of air.

The pressure in the reactor can be varied using control elements as well as the temperature. One way to do this is by changing the methanol quantity pumped by pump P1, for example by changing the speed or lift or by means of a variable throttle disposed on the suction side of pump P1. A further way is to use a pressure control valve on the pressure side of pump P1 to adjust the pressure in the reactor irrespective of the reactor temperature.

The motor fuel mixture produced in reactor 3 can, if necessary, be aftertreated or intermediately stored in a chamber 4 downstream of reactor 3.

The invention claimed is:

1. An apparatus, comprising:

a reactor that converts an alcohol into a fuel mixture by a reaction, the fuel mixture consisting of alcohol, ether, and water, and being suitable for operating a combustion engine;

a heating device that heats the alcohol before the alcohol enters the reactor;

a control device that adjusts a mixing ratio of an alcohol fraction, an ether fraction, and a water fraction in the fuel mixture by adjusting at least one reaction parameter of the reaction taking place in the reactor, wherein the control device adjusts the at least one reaction parameter taking into account a first measurement signal indicating an operating parameter of an exhaust-gas aftertreatment system and a second measurement signal indicating an operating parameter of the combustion engine including at least one of speed, load, acceleration, cylinder pressure, and knocking.

2. The apparatus according to claim 1, wherein the heating device consists of an exhaust-gas heat exchanger for heating and a second heat exchanger with air or liquids as a transfer medium for cooling, at least one of the exhaust-gas heat exchanger and the second heat exchanger is controllable by the control device to control the heat transfer to the alcohol flowing therethrough.

3. The apparatus according to claim 1, wherein the at least one reaction parameter is the reaction temperature or the reaction pressure in the reactor, and wherein the second heat exchanger is disposed between the exhaust-gas heat exchanger and the reactor and uses the ambient air or a liquid to cool the alcohol heated in the exhaust-gas heat exchanger to at least one of a temperature and pressure value suitable for the reaction taking place in the reactor.

4. The apparatus according to claim 3, further comprising at least one sensor that measures the reaction temperature and the reaction pressure in the reactor and transmits the measured values as measurement signals to the control device.

5. The apparatus according to claim 1, further comprising at least one of a cylinder pressure sensor and a knocking sensor on the combustion engine that transmits measurement signals to the control device as operating parameters of the combustion engine, the control device adjusting at least one of the heating of the alcohol to be converted and the pressure in the reactor based on the measurement signals.

6. The apparatus according to claim 5, wherein the control device adjusts at least one of the heating of the alcohol to be converted and the pressure in the reactor based on the speed and load of the combustion engine.

7. The apparatus according to claim 1, wherein the control device adjusts at least one of the heating of the alcohol to be converted and the pressure in the reactor based on the speed and load of the combustion engine.

8. The apparatus according to claim 1, wherein the combustion engine is an internal combustion engine in a motor vehicle.

9. The apparatus according to claim 1, wherein the second measurement signal indicates the speed of the combustion engine.

10. The apparatus according to claim 1, wherein the second measurement signal indicates the cylinder pressure of the combustion engine.

11. The apparatus according to claim 1, wherein the second measurement signal indicates knocking of the combustion engine.

12. The apparatus according to claim 1, wherein the second measurement signal indicates the load of the combustion engine.

13. The apparatus according to claim 1, wherein the second measurement signal indicates the acceleration of the combustion engine.

14. The apparatus according to claim 1, wherein the at least one reaction parameter is the reaction temperature or the reaction pressure in the reactor.

* * * * *